US006708742B2

(12) United States Patent
Weathers et al.

(10) Patent No.: US 6,708,742 B2
(45) Date of Patent: Mar. 23, 2004

(54) LEAF AND DEBRIS CHUTE

(76) Inventors: Larry V. Weathers, 4850 Park Pl. East, North Charleston, SC (US) 29405; Linda Howell Weathers, 4850 Park Pl. East, North Charleston, SC (US) 29405

( * ) Notice: Subject to any disclaimer, the term of this patent is extended or adjusted under 35 U.S.C. 154(b) by 0 days.

(21) Appl. No.: 10/098,578

(22) Filed: Mar. 15, 2002

(65) Prior Publication Data

US 2003/0173471 A1 Sep. 18, 2003

(51) Int. Cl.[7] ..... B65B 1/04
(52) U.S. Cl. ..... 141/391; 248/99
(58) Field of Search ..... 248/99, 100, 101, 248/903, 907; 141/390, 391, 108, 114, 313; 224/257; 294/1.1; 53/390

(56) References Cited

U.S. PATENT DOCUMENTS

| | | | | | |
|---|---|---|---|---|---|
| 435,638 | A | * | 9/1890 | Barnes | 141/341 |
| 1,167,728 | A | * | 1/1916 | Richards | 141/108 |
| 3,848,841 | A | * | 11/1974 | Rafeldt | 248/99 |
| 4,312,531 | A | * | 1/1982 | Cross | 294/55 |
| 4,461,441 | A | * | 7/1984 | Briggs | 248/100 |
| 4,597,203 | A | | 7/1986 | Middleton | |
| 4,791,779 | A | | 12/1988 | Hoffman | |
| 4,946,118 | A | * | 8/1990 | Hastings | 248/97 |
| 4,981,274 | A | | 1/1991 | McVay et al. | |
| 5,167,390 | A | * | 12/1992 | Baghdadi | 248/99 |
| 5,205,107 | A | * | 4/1993 | Herink | 53/255 |
| 5,207,107 | A | * | 5/1993 | Wolf et al. | 73/861.04 |
| 5,308,027 | A | | 5/1994 | Fullilove | |
| 5,395,079 | A | * | 3/1995 | Jensen et al. | 248/62 |
| 5,546,738 | A | | 8/1996 | Turner | |
| 5,785,369 | A | * | 7/1998 | Ridley et al. | 294/1.1 |
| D401,027 | S | | 11/1998 | Mueller | |
| 5,864,919 | A | | 2/1999 | Pineda | |
| 6,151,875 | A | | 11/2000 | Collins | |
| 6,226,970 | B1 | | 5/2001 | Busboom et al. | |
| 6,293,505 | B1 | | 9/2001 | Fan | |
| 6,378,577 | B1 | * | 4/2002 | Piner et al. | 141/391 |

* cited by examiner

*Primary Examiner*—Ramon O. Ramirez
(74) *Attorney, Agent, or Firm*—Harleston Law Firm LLC; Kathleen M. Harleston

(57) ABSTRACT

A chute apparatus for collecting leaves and debris includes: (a) an upper chute portion having an open front portion, the chute portion including a back portion with a front end that is wider than its rear end, and two smaller, matching chute sides attached to either side of the back chute portion; and (b) an open-ended lower channel portion connected to the chute portion, the channel portion having four sides: an upper section, a channel back section opposite to the channel upper section, and two narrower channel side sections, which are opposite to one another and which connect the channel upper section to the channel back section. The chute apparatus may also include clips on the sides, or an external ridge, for removably attaching the edges of a trash bag. In one embodiment, which does not include a channel portion, the chute sides are hinged for achieving a folded, storage position and various open positions with different degrees of angle.

11 Claims, 7 Drawing Sheets

LEAF AND DEBRIS CHUTE

BACKGROUND OF THE INVENTION

1. Technical Field

The present invention relates to a chute apparatus for facilitating leaf and debris collection.

2. Background Information

Many municipalities have relatively new laws prohibiting the dumping or burning of leaves and other debris. The debris must therefore be collected in trash bags, sometimes a specific type, size or color of trash bag, and set on the curb for pickup by a trash service, or hauled to a specified disposal location. Unfortunately, raking up and bagging fall leaves is difficult for a single person to undertake, particularly if the individual is handicapped or infirm. Once the leaves are raked into piles, it is difficult to hold the garbage or leaf bag open and at the same time insert handfuls of slippery leaves. Some people put one foot on the edge of the trash bag, lean over and hold the bag open with one hand, and attempt to scoop in leaves with the other hand. Since only a comparative few leaves can be inserted with each handful or rake full, the job is labor intensive and sometimes results in back sprains, spasms, and aching muscles.

The inexpensive chute apparatus of the present invention makes collecting leaves quicker and easier. It markedly decreases the amount of bending and stretching necessary to do yard work, and is especially helpful for older or infirm people. It can also be used for collecting outdoor trash, such as discarded napkins, paper cups, brochures, and other debris after a church festival, for example. It is versatile and can be used with a trash bag or garbage can. The chute apparatus can be hung in the garage or stored outdoors when it is not in use. A smaller, lightweight embodiment can be used indoors for sweeping up debris on a table, in a work space, etc.

BRIEF SUMMARY OF THE INVENTION

The present invention is a chute apparatus for collecting leaves or debris, which includes:

(a) an upper chute portion having an open front portion, the chute portion comprising a back portion, the back chute portion having a front end that is wider than its rear end, and two matching chute sides attached to either side of the back chute portion, the front end of the back chute portion being wider than each of the chute sides; and (b) an open-ended lower channel portion connected to the chute portion, the channel portion comprising four sides: an upper section, a channel back section opposite to the channel upper section, and two narrower channel side sections, which are opposite to one another and which connect the channel upper section to the channel back section;

wherein the narrower end of the back chute portion is connected to the channel back section; and the two chute sides are connected at their lower ends to upper ends of the two opposite channel sides.

Also included herein is an alternate embodiment comprising a chute portion without a channel portion, wherein the chute sides are hinged to the back chute portion; an alternate embodiment comprising clips on the sides for holding a trash bag on the outside of the channel portion; and an alternate embodiment comprising a partial front portion and a ridge for holding a trash bag.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 4 is a perspective view of the chute apparatus of FIG. 3, shown with a trash bag clipped on;

DETAILED DESCRIPTION OF THE INVENTION

Figure 1:
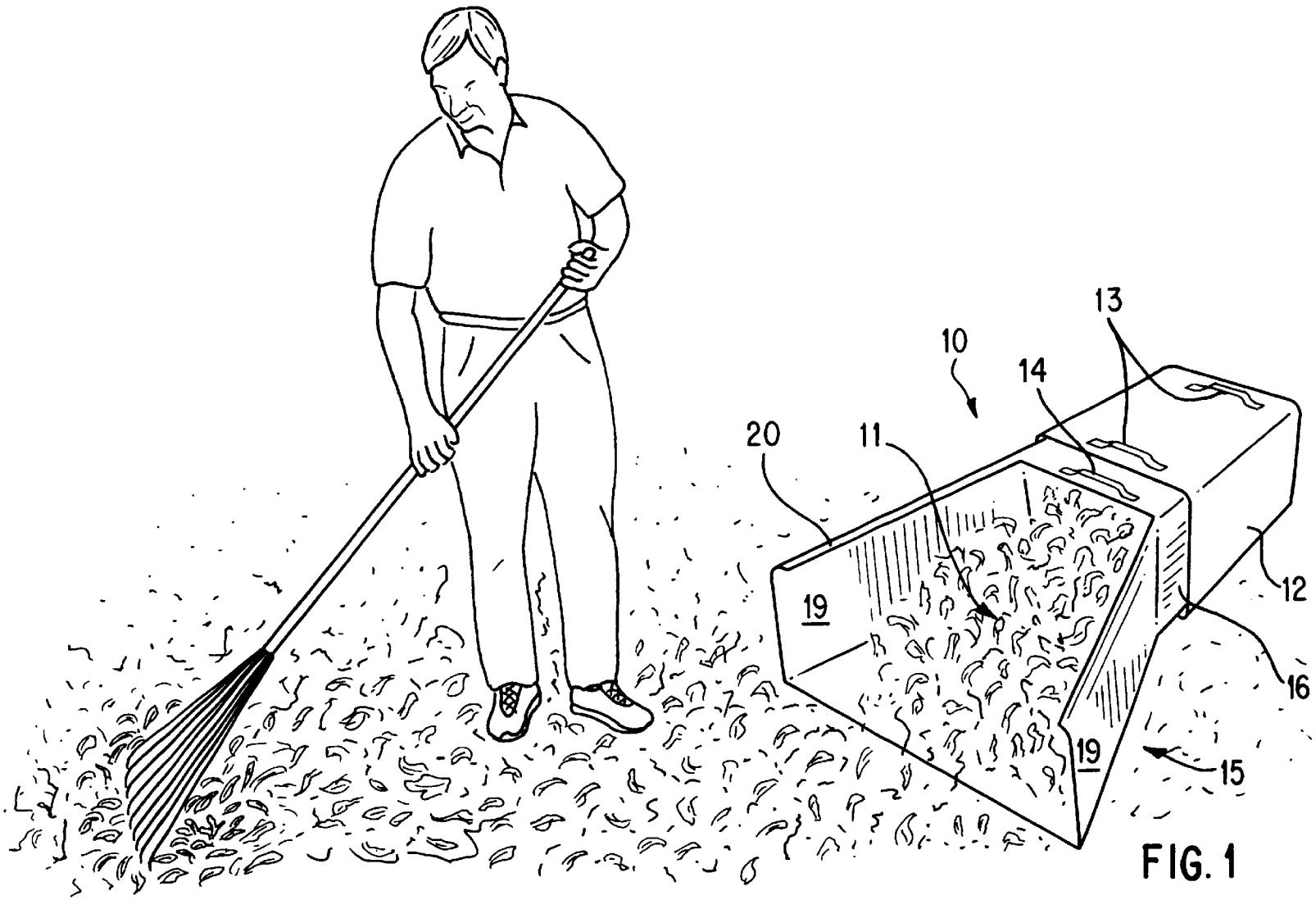
FIG. 1 shows a perspective view of a chute apparatus according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a chute apparatus, generally referred to as 10, according to the present invention is shown in use on a lawn. In FIG. 1, a user is raking fallen leaves 11 and other lawn debris into the chute apparatus 10, which has been placed on its back on the ground. A lower portion of the chute apparatus 10 fits closely into a trash receptacle 12, which is also laying on its back. The chute apparatus 10 may include a trash receptacle 12 designed to fit closely over the chute apparatus, or an appropriately sized conventional open trash receptacle may be employed. The trash receptacle 12 preferably includes upper and lower handles 13 on its upper side for lifting the trash receptacle 12 with the chute apparatus 10 in it. The chute apparatus 10 preferably also includes a handle 14 on its upper side, as shown in FIG. 1, for aid in lifting the chute apparatus out of the trash receptacle once it is full, or the task has been completed.

Figure 2:
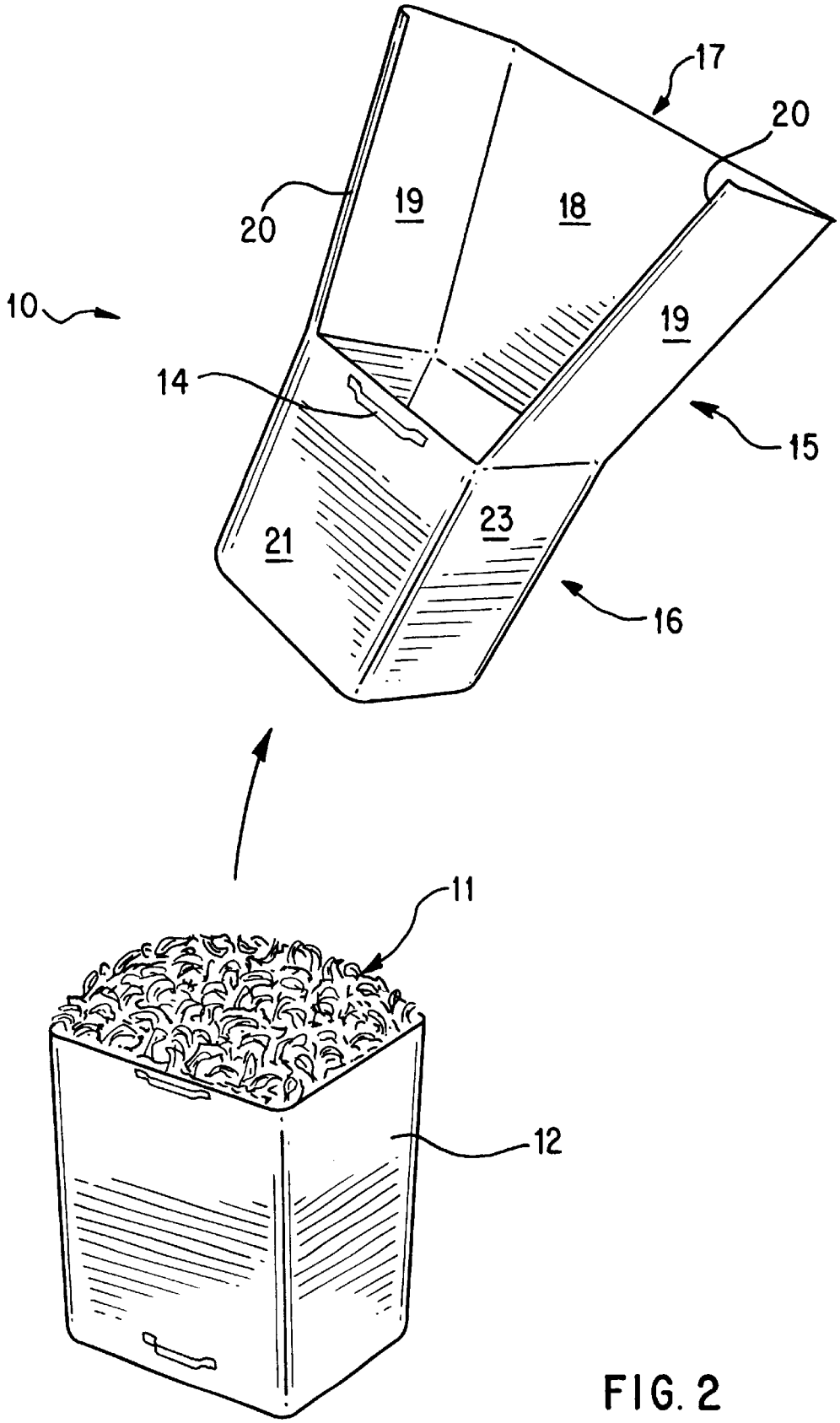
FIG. 2 is a perspective view of the chute apparatus according to FIG. 1, shown with a full trash can.

Referring to FIGS. 1 and 2, the chute apparatus 10 is comprised of an upper chute portion 15 and a lower channel portion 16. The channel portion is preferably generally rectangular or square-shaped as shown, although it can be semi-circular in cross-section. The leaves 11 and other debris are raked into an open front portion 17 of the chute portion 15. The open front portion of the chute portion is narrower than the rear portion of the chute. The chute portion 15 comprises a back portion 18, which is wider in the front than the rear. The back portion 18 preferably has straight edges, but its longitudinal sides may alternatively be slightly curved in at its mid-section, forming a generally hour glass shape (not shown). The back chute portion 18 is bordered on its opposite long edges by two chute sides 19, the chute sides being approximately at right angles to the back portion 18. Each of the chute sides 19 and the chute back portion 18 preferably form an angle of between about 80 and 110 degrees. This angle facilitates collection of the debris being swept into the front of the chute portion. The upper edges of the two chute sides preferably project outward slightly, forming flanges 20. In addition to giving additional strength to the chute, the flanges 20 catch some of the stray debris that is tossed up by the raking action.

Continuing with FIG. 2, the open-ended channel portion 16 comprises four sides: an upper section 21, a channel back section 22 opposite to the upper section, and two narrower channel side sections 23, which are opposite to one another and which connect the channel upper section 21 to the channel back section 22. The narrower end of the back chute portion 18 is connected to the back section 22 of the channel portion, which is preferably generally rectangular or square in shape. The seam between the two sections is smooth so as not to impede movement of the debris through the channel portion 15; in fact, the two sections may be formed of one molded piece, or the entire chute apparatus may be formed in a mold. The chute apparatus is preferably made of a plastic (most preferred), wood, aluminum, or resin material, although it can be made of any suitable synthetic or naturally occurring material. The two chute sides 23 are connected (or continuous) at their lower ends to the upper ends of the two opposite channel sides 23. Both ends of the channel portion 16 are open to allow passage of the debris from the chute portion 15 into the trash receptacle 11.

To use the chute apparatus 10, the channel portion 16 of the chute apparatus is placed into an empty trash receptacle 12. The chute apparatus 10 may include its own close-fitting trash receptacle, or a conventional garbage can may be used. If the chute apparatus includes a trash can, two handles are preferred at opposite ends of the front face of the trash can (see FIG. 1) to facilitate lifting the trash can when it is full. The chute apparatus and trash receptacle are then tipped over onto their backs on the ground in the desired location of the yard, as shown in FIG. 1. The chute apparatus is then in a generally horizontal position. A pile of leaves or other debris is swept into the open front of the chute portion 15. Once the user is finished, he or she upends the chute apparatus and receptacle, so the chute apparatus is in a generally vertical position. The user then pulls the chute apparatus 10 out of the trash receptacle, as shown in FIG. 2, preferably shaking the chute apparatus 10 as it is removed so the leaves 11 remain in the trash receptacle 12. The chute apparatus 10 lifts easily and cleanly out of the trash can. The leaves and other debris in the trash receptacle are then disposed of in a conventional manner.

Once the yard work is complete for the day, the chute apparatus 10 can be stored in the garage or, since it is preferably made of a durable plastic material, outdoors until its next use. Since it is durable and has no sharp edges, small children can crawl through it and play with it between uses. The chute handle 14 preferably projects away from the front of the chute portion, as shown in FIG. 2, so it can be hung over a nail or hook in a garage wall for off-the-ground storage of the chute apparatus.

Second Embodiment

Figure 3:
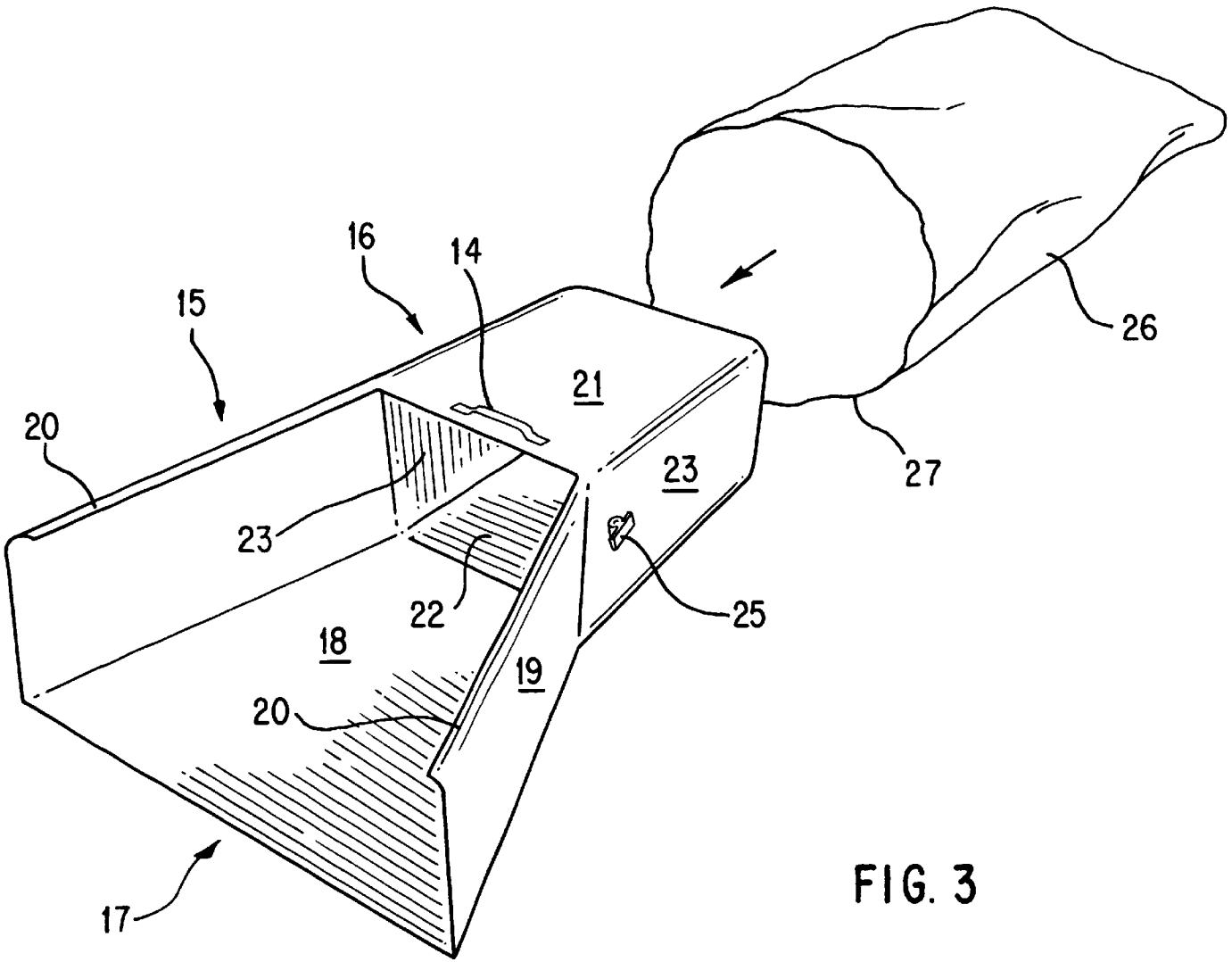
FIG. 3 is a perspective view of an alternate embodiment of a chute apparatus according to the present invention, shown with a trash bag.
Figure 4:
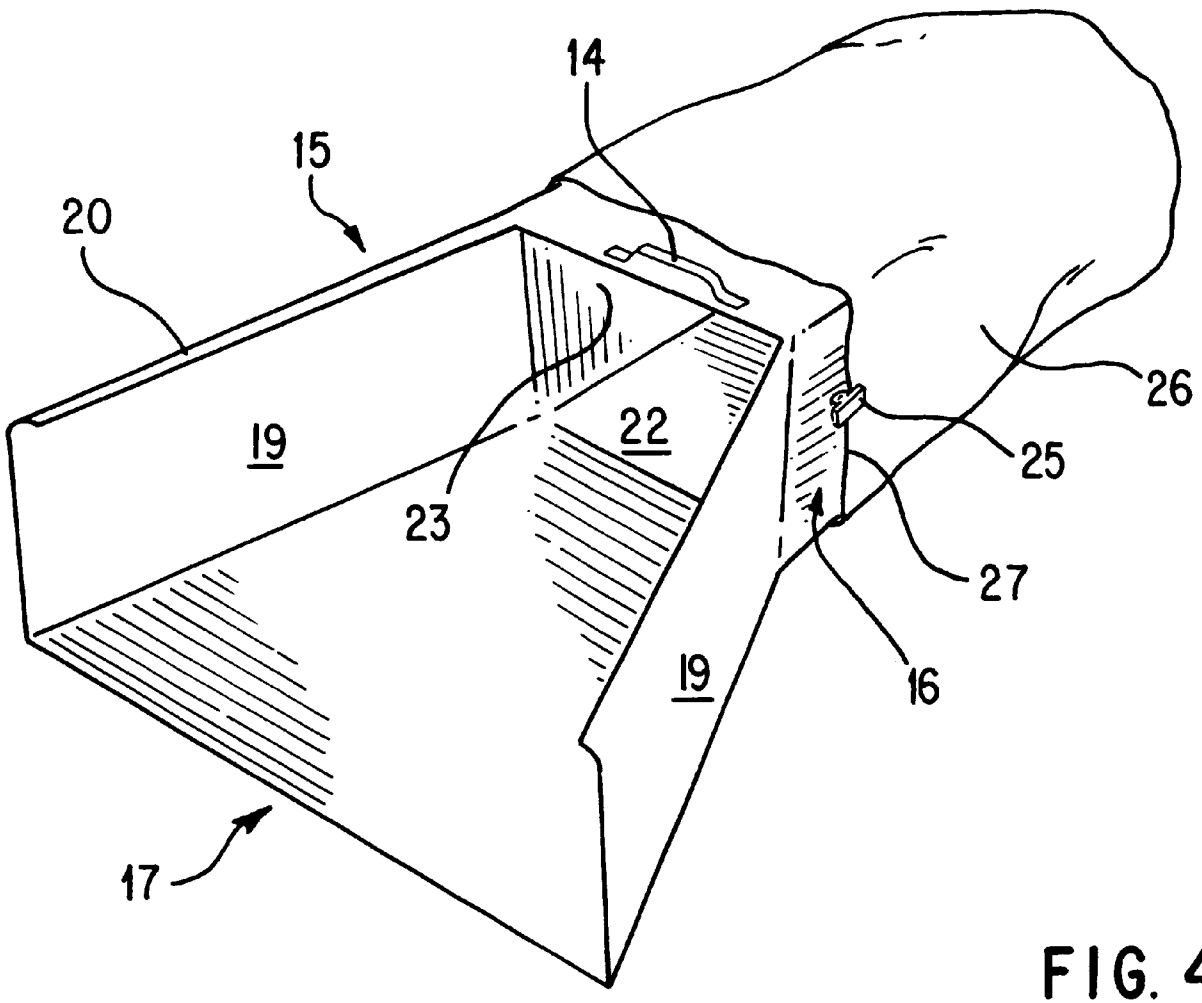

Alternatively, as illustrated in FIGS. 3 and 4, clips 25 are attached to the outside of the two channel side sections 23 for removable attachment of a trash bag. This most preferred, lightweight embodiment employs a trash bag 26 instead of a trash receptacle for holding the leaves/debris. The rigid channel portion 16 holds the upper part of the trash bag 26 open while the leaves are loaded in. This decreases the labor involved in yard work. With this apparatus, a second person is not required to hold the trash bag open while the first person loads it with leaves.

To use this embodiment, the user pulls the upper part of a conventional plastic trash bag 26 over the outside of the channel portion 16, as shown in FIG. 3, and attaches an upper edge 27 of the trash bag to the clips 25 on either side of the channel portion, as shown in FIG. 4. Other suitable means of attachment, such as clamps or snaps, may be used instead of clips. The user then lays the chute apparatus 10 on its back near the leaf pile or other debris to be collected. Once the user rakes the leaves, mulch or other debris into the chute portion 15 of the chute apparatus 10, he or she tips the chute apparatus up, shakes it a few times, unfastens the top edge 27 of the trash bag 26 from the clips 25, and sets the chute apparatus aside. The user then closes the top of the loaded trash bag and disposes of it in a conventional, acceptable manner. The user can then load another trash bag 26 onto the chute apparatus 10 and repeat the process. This embodiment is particularly well-suited for disposing of lightweight debris, such as fallen leaves. The leaves slide easily into the leaf bag without tearing the bag.

Third Embodiment

Figure 5:
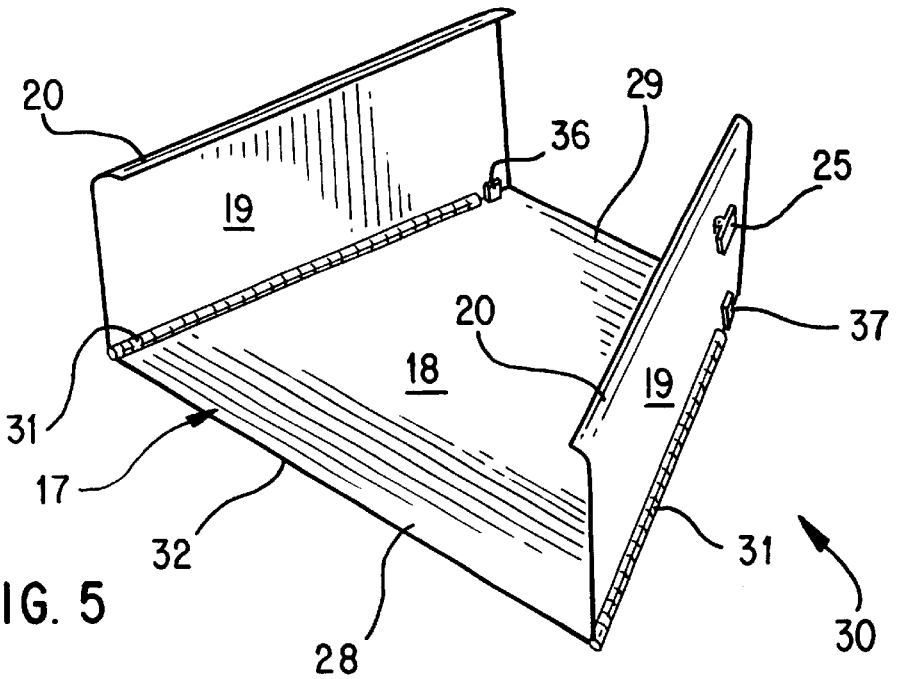
FIG. 5 is a perspective view of an alternate embodiment of a chute apparatus according to the present invention.
Figure 6:
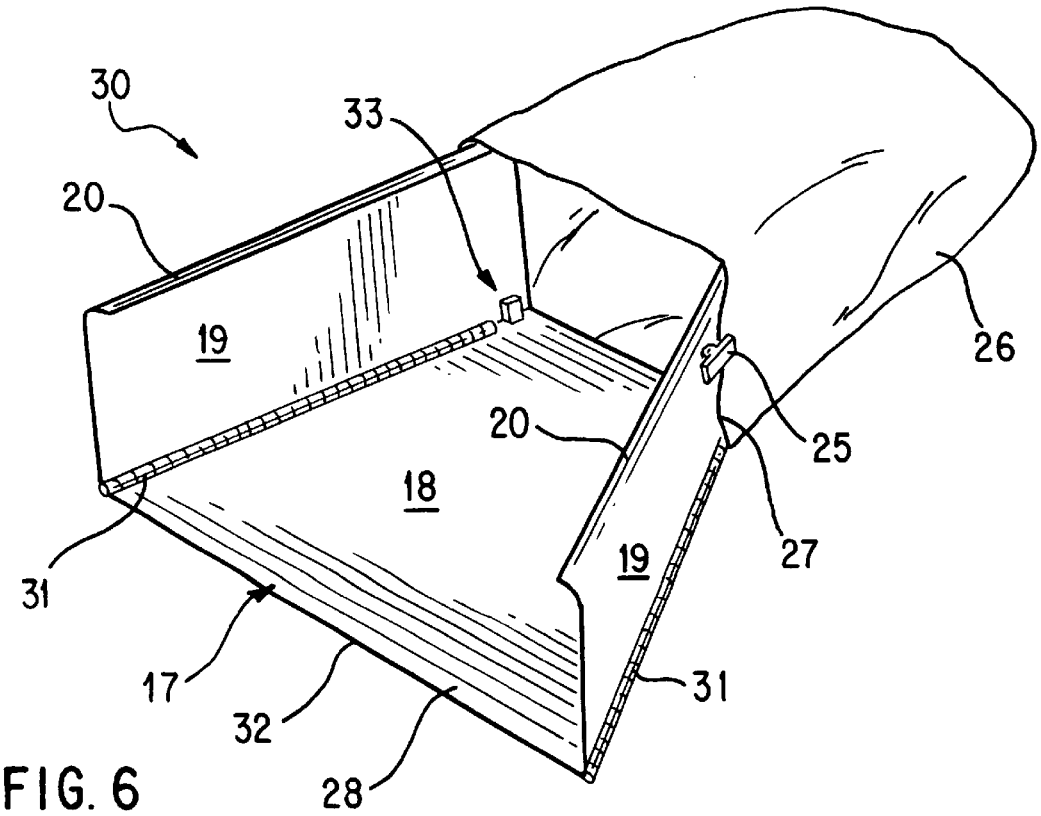
FIG. 6 is a perspective view of the chute apparatus of FIG. 5, shown with a trash bag.
Figure 7:
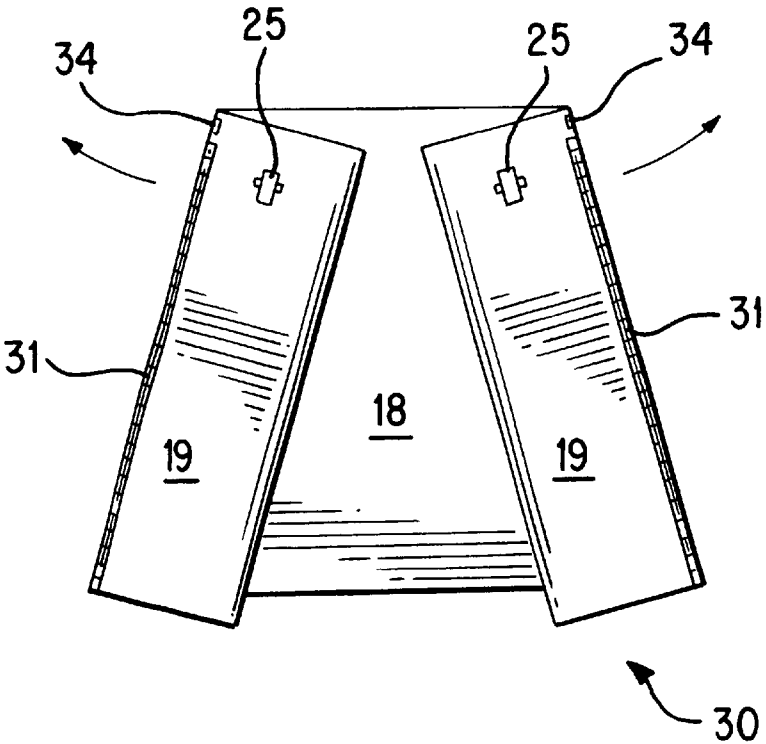
FIG. 7 is a top plan view of the chute apparatus of FIG. 6, shown in a folded position.

Turning now to FIGS. 5 through 8, an alternate embodiment 30 of the chute apparatus is collapsible to a flat position, as shown in FIG. 7, for easy storage on a shelf, under a porch, etc. As is apparent from FIGS. 5 and 7, this embodiment 30 of the chute apparatus has a chute portion 15, but no channel portion. This chute apparatus 30 comprises an open front portion 17; a back portion 18 having a front end 28 that is wider than its rear end 29; and two matching chute sides 19 attached to either side of the back chute portion 18. The front end of the back chute portion 18 is wider than each of the chute sides 19; and an upper edge of each chute side forms a flange 20. The flanges 20, strengthen the chute and catch a certain amount of airborne debris. The two chute sides 19 are hinged along opposite sides of the back chute portion 18. In each of these embodiments, the front edge 32 of the chute may be sloped downward to facilitate collection of small debris.

As seen in FIGS. 5–7, the hinges 31 connecting the chute sides 19 to the back chute portion 18 preferably extend substantially the length of the chute sides 19. The hinges 31 are preferably stepped so that the side flaps 19 can be opened at any desired angle and remain in position until they are moved again by the user. This is advantageous because the user may wish to have the chute sides 19 at right angles to the back chute portion 18 for assisting in collecting a small amount of lightweight debris (e.g., from sweeping the kitchen), or at a wider, obtuse angle to prevent larger debris, or a large pile of debris, from escaping along the outer edges of the chute. In the folded, storage-ready position shown in FIG. 7, the inside surface of the side flaps 19 contact the inside surface of the back chute portion 18. The side flaps 19 open outwardly in the direction of the arrows shown in FIG. 7. In addition to allowing for a folded, storage position, then, the hinges 31 permit various open positions with different degrees of angle. This chute apparatus is also preferably made of a plastic-type material. The first and second embodiments herein, which are shown in FIGS. 1 and 2, and 3 and 4, respectively, may similarly comprise hinges 31 in the chute portion 15.

In use, the front edge 27 of a standard sized trash bag 26 is attached to the chute apparatus 30 by means of clips 25, as shown in FIG. 6. The clips 25 are attached to the outside lower end portion of each of the chute sides 19 (see FIG. 7) for the removable attachment of a trash bag to the chute apparatus.

Figure 8:
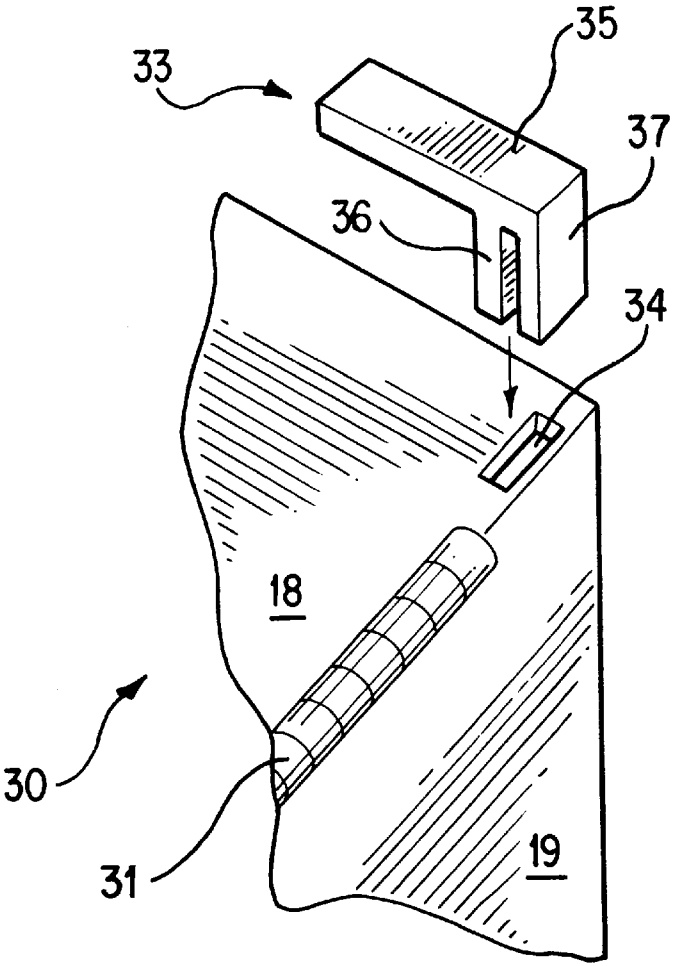
FIG. 8 is a perspective view of a corner portion of the chute apparatus according to FIG. 5.

As shown in FIGS. 6 and 8, one option for holding the chute sides 19 in an open position during use is a removable key 33 and corresponding aperture 34 in each chute side. The key 33 preferably has the shape of a capital "F", as shown in FIG. 8. The F-shaped key has a long spine 35 and two prongs at a right angle to the spine 35. Each chute side has one aperture at its lower end (therefore the trash bag obscures the key in FIG. 6). The aperture 34 has the same shape as a lower prong 36 of the F-shaped key in cross-section. The lower prong 36 therefore closely fits through the aperture 34 from which placement it projects into an interior of the chute 30. When the key 33 is in place in the aperture 34, the spine 35 of the F-shaped key 33 is adjacent to and supports the outside surface of a chute side 19. When the key 33 is in the aperture 34, an outer (upper) prong 37 of the "F" key is adjacent to and supports the outside surface of the back chute portion 18. The two keys 33 are placed in the apertures 34 on both sides of the chute by the user to hold the chute apparatus 30 in an open position.

Fourth Embodiment

Figure 9:
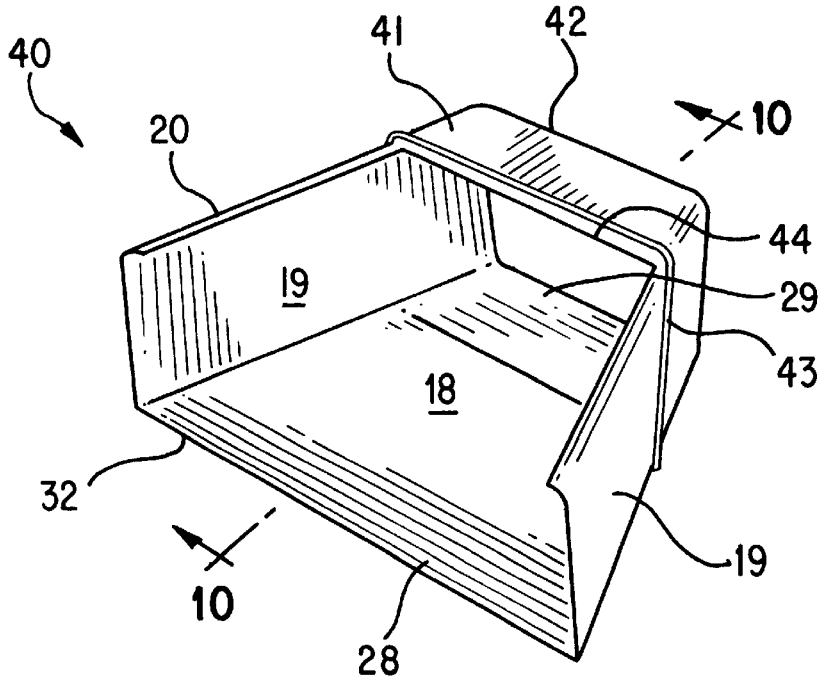
FIG. 9 is a perspective view of an alternate embodiment of a chute apparatus according to the present invention.
Figure 10:
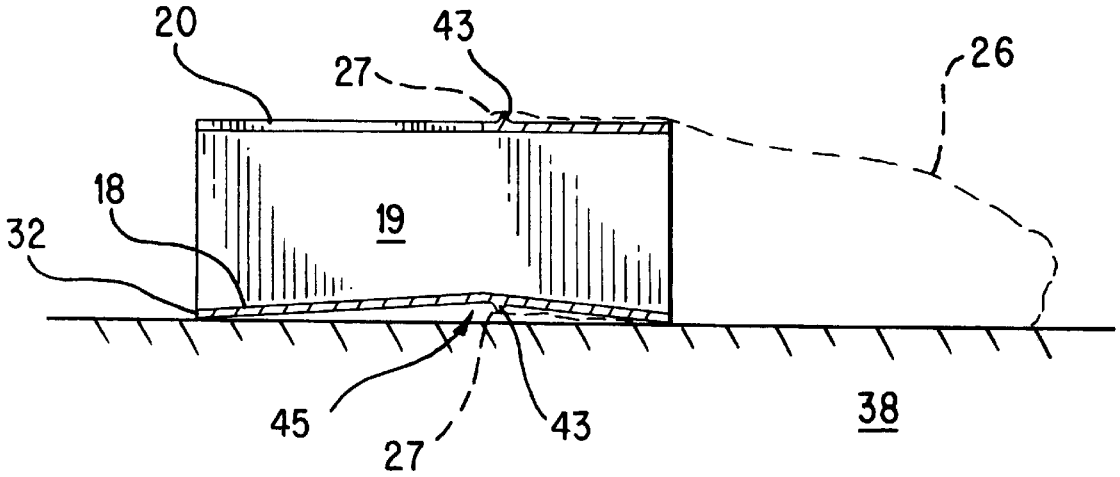
FIG. 10 is a cross-sectional view of the chute apparatus of FIG. 9, taken across line 10—10.

FIGS. 9 and 10 show a fourth alternate embodiment 40 of the chute apparatus, which can be used outdoors or indoors. In addition to facilitating collection of leaves and other debris outdoors, it can be used indoors, for example for collecting crumbs and other refuse swept up from a table surface, work space, or kitchen floor. This embodiment 40 of the chute apparatus comprises open front and rear ends; a back chute portion 18 with a front end 28 that is wider than its rear end 29; and two matching chute sides 19 attached to either side of the back chute portion 18. The front end of the back chute portion 18 is wider than each of the chute sides 19. An upper edge of each chute side forms a flange 20. The chute apparatus 40 further comprises a partial front portion 41 with a rear edge 42 that is continuous with the rear edges of the two adjacent chute sides and the back chute portion 18. As shown in FIG. 9, a small ridge 43 encircles the chute apparatus 40, passing just below the front edge 44 of the partial front portion 41. The partial front portion 41 adds strength to the structure, and a convenient handle, front edge 44, for picking up and directing the apparatus.

FIG. 10 shows the chute apparatus 40 in cross-section. This cross-section is taken across lines 10—10 of the chute apparatus of FIG. 9. The ridge 43 can be seen along the upper front portion 41 and the outside of the lower back portion 18. For purposes of illustration, a trash bag is shown in outline in FIG. 10. Because the trash bag is a standard size, it has a known diameter and its upper edge fits closely over the ridge 43. The ridge dispenses with the need for clips or other means of attachment. Even though the edge of the trash bag fits tautly over the ridge, it is easy to put on and, once the task is complete, remove. The ridge may include a slit at one point for the insertion of a clip or clothespin if tighter attachment of the edge of the trash bag is needed.

In FIG. 10, the chute apparatus 40 is shown lying on the ground 38. It can be seen that the back chute portion 18 is somewhat bent, or buckled, inward at its midsection 45 towards the interior of the chute. This feature forces the front edge 32 of the back chute portion 18 to press into the ground 38. Since the ground is often relatively soft or grassy, this facilitates the raking of leaves, or the sweeping of crumbs or other debris, into the chute apparatus. On the other hand, the bend is not marked, so the slope to the ribbed midsection 45 is not steep enough to disrupt the flow of the debris down the chute into the trash bag 26 or other trash receptacle. This feature is preferably present in all embodiments of the present invention. In this embodiment, the ridge 43 along the outside (bottom) of the back chute portion 18 projects slightly into the ground, which also helps to maintain the chute apparatus in position. Since the back chute portion 18 is bent inward, the bottom edge of the chute sides 19 where they meet the back portion 18 are also slightly V-shaped to compensate.

Any of these embodiments are available in a larger size, which will work with a 30 to 60 gallon trash can or bag, for example, for yard work, and medium or smaller sizes, which will work with a 10 to 15 gallon trash can or bag, for example, for indoor use. The fourth embodiment herein with an accompanying five to ten gallon trash can is preferred for indoor use. In the latter case, the front portion of the chute portion is preferably slightly wider than the width of a broom. The second embodiment herein is preferred for outdoor use.

The trash can 11 and/or the chute apparatus 10, 30, 40 optionally includes two wheels, particularly for the larger embodiments herein. One wheel is attached to each end of a lower edge of the trash can or chute apparatus. To move the trash can or chute apparatus, the user leans the trash can or chute back on the wheels, lifting the opposite edge off the ground, and pushes the trash can or chute to the desired location.

From the foregoing it can be realized that the described device of the present invention may be easily and conveniently utilized for the collection of fallen leaves or other debris. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Brief List of Reference Numbers Used in the Drawings

10 chute apparatus
11 leaves
12 trash receptacle
13 trash receptacle handles
14 chute handle
15 chute portion
16 channel portion
17 open front portion of chute
18 back chute portion

19 chute sides
20 flanges
21 channel upper section
22 channel back section
23 channel side sections
25 clip
26 trash bag
27 edge of trash bag
28 front end of back chute portion
29 rear end of back chute portion
30 alternate embodiment of chute apparatus
31 hinge
32 front edge
33 key
34 aperture in chute side
35 spine of F-shaped key
36 lower prong of F-shaped key
37 outer prong of F-shaped key
38 ground
40 fourth alternate embodiment of chute apparatus
41 partial front portion
42 rear edge of front portion
43 ridge
44 front edge of front portion
45 bent midsection

What is claimed is:

1. A chute apparatus for collecting leaves or debris, the apparatus comprising:

(a) an upper chute portion having an open front portion, the chute portion comprising a back portion, the back chute portion having a front end that is wider than its rear end, and two matching chute sides attached to either side of the back chute portion, the front end of the back chute portion being wider than each of the chute sides;

(b) an open-ended lower channel portion connected to the chute portion, the channel portion comprising four sides: an upper section, a channel back section opposite to the channel upper section, and two narrower channel side sections, which are opposite to one another and which connect the channel upper section to the channel back section; and (c) clips, which are attached to the outside surface of the two side sections of the channel portion, for removable attachment of a trash bag to a bottom portion of the chute apparatus;

wherein the narrower end of the back chute portion is connected to the channel back section; and the two chute sides are connected at their lower ends to upper ends of the two opposite channel sides.

2. A chute apparatus according to claim 1, wherein the upper edge of each chute side forms a flange.

3. A chute apparatus according to claim 2, wherein the chute sides and chute back portion are at an angle of between about 80 and 110 degrees.

4. A chute apparatus according to claim 1, wherein the back chute portion is bent inward at its midsection.

5. A chute apparatus according to claim 4, further comprising a trash can, which closely fits over a majority of the outside of the channel portion.

6. A chute apparatus for collecting leaves and debris, the apparatus comprising open front and rear ends; a back chute portion, with a front end that is wider than its rear end; and two matching chute sides attached to either side of the back chute portion, the front end of the back chute portion being wider than each of the chute sides; and wherein an upper edge of each chute side forms a flange; the apparatus further comprising a partial front portion adjacent to the chute sides, the front portion having a rear edge that is continuous with the rear edges of the two adjacent chute sides and the back chute portion.

7. A chute apparatus according to claim 6, wherein the back chute portion is bent inward at its midsection.

8. A chute apparatus according to claim 6, wherein the front edge of the back chute portion is sloped downward.

9. A chute apparatus according to claim 6, further comprising a small ridge encircling the chute apparatus, the ridge passing just below a front edge of the partial front portion.

10. A chute apparatus for collecting leaves and debris, the apparatus comprising open front and rear ends; a back chute portion, with a front end that is wider than its rear end; and two matching chute sides attached to either side of the back chute portion, the front end of the back chute portion being wider than each of the chute sides; and further comprising a removable key and corresponding aperture in each chute side for holding the chute sides in an open position during use; and wherein an upper edge of each chute side forms a flange.

11. A chute apparatus according to claim 10, wherein the key is "F" shaped, a lower prong of the "F" key closely fitting through the aperture into an interior of the chute portion, a spine of the "F" key supporting a chute side, and an outer prong of the "F" key supporting the back chute portion.

* * * * *